US010818422B2

(12) United States Patent
Nagai et al.

(10) Patent No.: US 10,818,422 B2
(45) Date of Patent: Oct. 27, 2020

(54) MULTILAYER COIL COMPONENT

(71) Applicant: TDK CORPORATION, Tokyo (JP)

(72) Inventors: Yuusuke Nagai, Tokyo (JP); Takashi Suzuki, Tokyo (JP); Kouichi Kakuda, Tokyo (JP); Kunihiko Kawasaki, Tokyo (JP); Shinichi Kondo, Tokyo (JP); Yuya Ishima, Tokyo (JP); Shinichi Sato, Tokyo (JP); Masaki Takahashi, Tokyo (JP); Takashi Endo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 351 days.

(21) Appl. No.: 15/895,567

(22) Filed: Feb. 13, 2018

(65) Prior Publication Data

US 2018/0233262 A1 Aug. 16, 2018

(30) Foreign Application Priority Data

Feb. 14, 2017 (JP) ..... 2017-025109

(51) Int. Cl.
*H01F 27/30* (2006.01)
*H01F 17/00* (2006.01)
*H01F 27/29* (2006.01)

(52) U.S. Cl.
CPC ..... *H01F 17/0013* (2013.01); *H01F 17/0033* (2013.01); *H01F 27/292* (2013.01); *H01F 2017/004* (2013.01); *H01F 2017/0073* (2013.01)

(58) Field of Classification Search
USPC ..... 336/200, 232, 192
See application file for complete search history.

(56) References Cited

U.S. PATENT DOCUMENTS

2017/0025219 A1 1/2017 Nagai et al.

FOREIGN PATENT DOCUMENTS

| | | | |
|---|---|---|---|
| CN | 106373711 | A | 2/2017 |
| JP | 2010-183007 | A | 8/2010 |
| JP | 2017-028143 | A | 2/2017 |
| KR | 2013-0019195 | A | 2/2013 |

*Primary Examiner* — Elvin G Enad
*Assistant Examiner* — Kazi S Hossain
(74) *Attorney, Agent, or Firm* — Oliff PLC

(57) ABSTRACT

In a multilayer coil component, an end of a lower coil layer and an end of a connecting part are directly overlapped, and the end of the lower coil layer includes a contact edge positioned on a side of the connecting part and being in contact with the connecting part and a non-contact edge positioned on a side opposite to the connecting part and not being in contact with the connecting part. Then, the contact edge and the non-contact edge are not overlapped when viewed from a laminated direction. Consequently, a propagation distance of a crack becomes longer as compared with the case where an end face is parallel to the laminated direction, effectively suppressing advance of the crack. Suppressed advance of a crack in this manner makes the multilayer coil component provide a high component strength as a whole.

6 Claims, 10 Drawing Sheets

MULTILAYER COIL COMPONENT

CROSS-REFERENCE TO RELATED APPLICATIONS

This application is based upon and claims the benefit of priority from Japanese Patent Application No. 2017-025109, filed on 14 Feb. 2017, the entire content of which is incorporated herein by reference.

TECHNICAL FIELD

The present disclosure relates to a multilayer coil component.

BACKGROUND

A DC-DC converter mounting thereon a coil component has been used in an electric power source of a mobile communication terminal and the like. A laminated type coil component (multilayer coil component) is used as the above-mentioned coil component from the standpoints of downsizing and the like. Such a multilayer coil component is disclosed in, for example, Japanese Unexamined Patent Publication No. 2010-183007 (Patent Literature 1).

The inventors of the present invention have found a new technique that can provide a higher component strength as a result of intensive research on improvement in component strength.

SUMMARY

The present disclosure provides a multilayer coil component improved in component strength.

A multilayer coil component according to an aspect of the present disclosure has a laminated structure and includes a coil inside an insulating body. The multilayer coil component includes a first coil part configured to be a part of the coil and extending in a layer forming the laminated structure, the first coil part having one end extending in one direction, and a second coil part configured to be a part of the coil and extending in a layer forming the laminated structure, the second coil part having one end extending in a direction opposite to the one end of the first coil part and directly overlapping the one end in a laminated direction. The one end of at least one of the first coil part and the second coil part has a contact edge positioned on a side of the other coil part and being in contact with the other coil part, and a non-contact edge positioned on a side opposite to the other coil part and not being in contact with the other coil part, and the contact edge and the non-contact edge are not overlapped when viewed from the laminated direction.

In the above-mentioned multilayer coil component, the one end of at least one of the first coil part and the second coil part includes the contact edge and the non-contact edge that are not overlapped when viewed from the laminated direction, so that an end face of the first end is inclined with respect to the laminated direction. In the above-mentioned multilayer coil component, a crack that extends along the end face of the one end of the one of the coil parts can be generated in the one end of the other coil part due to stress from outside of the component. In this context, when the end face is inclined with respect to the laminated direction, advance of crack in the one end of the other coil part is suppressed as compared with the case where the end face is parallel to the laminated direction. Such a suppressed advance of a crack improves component strength of the multilayer coil component as a whole.

An aspect may be employed in which both of the one ends of the first coil part and the second coil part have the contact edge and the non-contact edge, and the contact edge and the non-contact edge are not overlapped when viewed from the laminated direction in both of the one ends of the first coil part and the second coil part. In this case, in both of the one ends of the first coil part and the second coil part, advance of crack is suppressed, improving further component strength.

An aspect may be employed in which the contact edge is positioned more to a distal end side in an end extending direction than the non-contact edge in the one end of at least one of the first coil part and the second coil part. In this case, a large contact area can be ensured between the first coil part and the second coil part, making it possible to reduce a direct current resistance of the coil An aspect may be employed in which the contact edge is positioned more to the distal end side in the end extending direction than the non-contact edge in both of the one ends of the first coil part and the second coil part. In this case, the direct current resistance of the coil can be further reduced.

An aspect may be employed in which the second coil part has a second end extending in one direction, and the multilayer coil component further includes a third coil part configured to be a part of the coil and extending in a layer forming the laminated structure, the third coil part extending in a direction opposite to the second end of the second coil part and having one end directly overlapping the second end on a side opposite to the first coil part with respect to the second coil part. An aspect may be employed in which a thickness of the second coil part is thinner than any of a thickness of the first coil part and a thickness of the third coil part.

DETAILED DESCRIPTION

Figure 1:
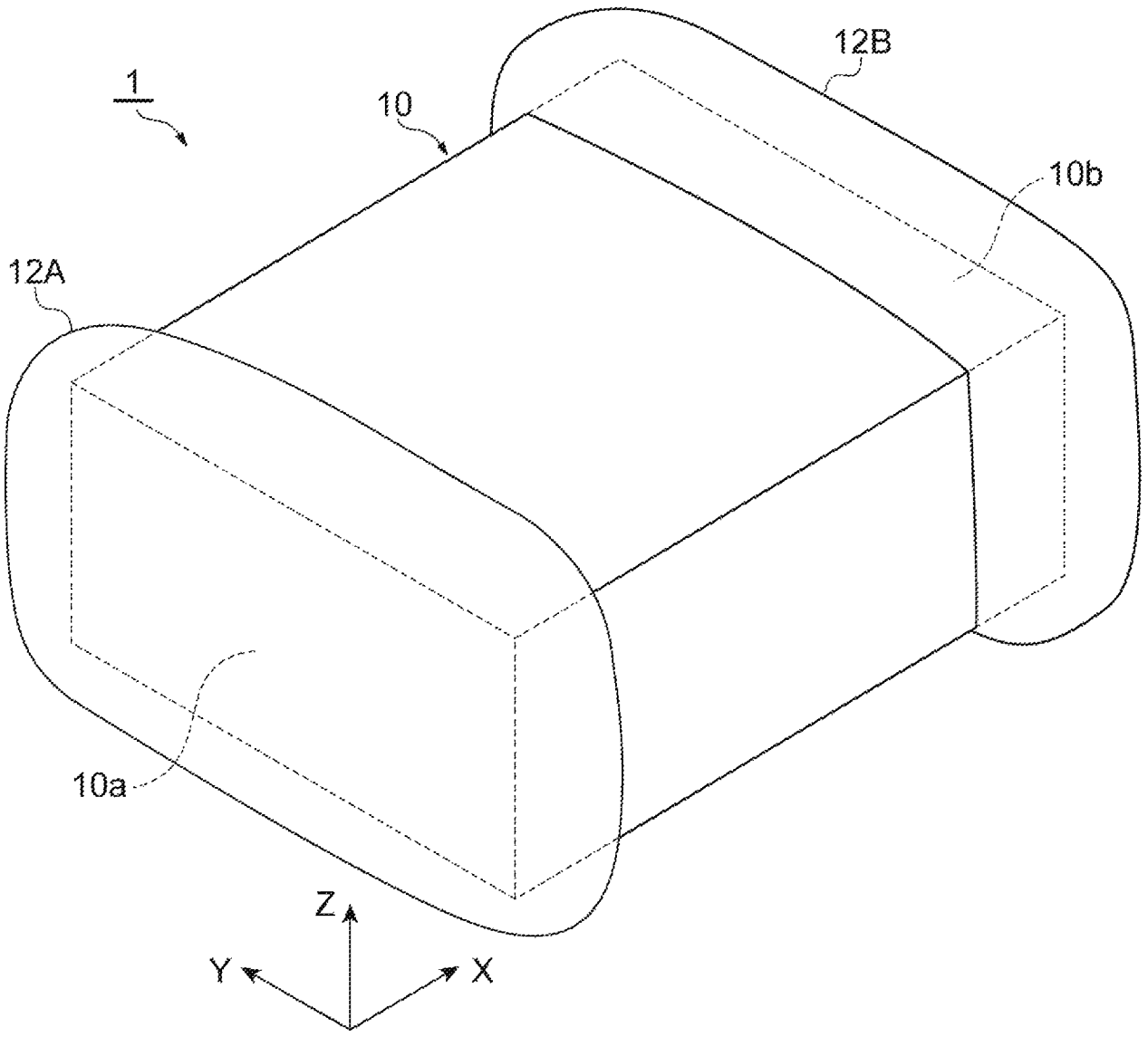
FIG. 1 is a perspective view schematically illustrating a multilayer coil component according to an embodiment.

Hereinafter, an embodiment will be described in detail with reference to the accompanying drawings. Note that the same reference numerals are used for the same elements or elements having the same functions, and the overlapped description will be omitted.

First, the overall structure of a multilayer coil component 1 according to the embodiment will be described with reference to FIGS. 1, 2.

Figure 2:
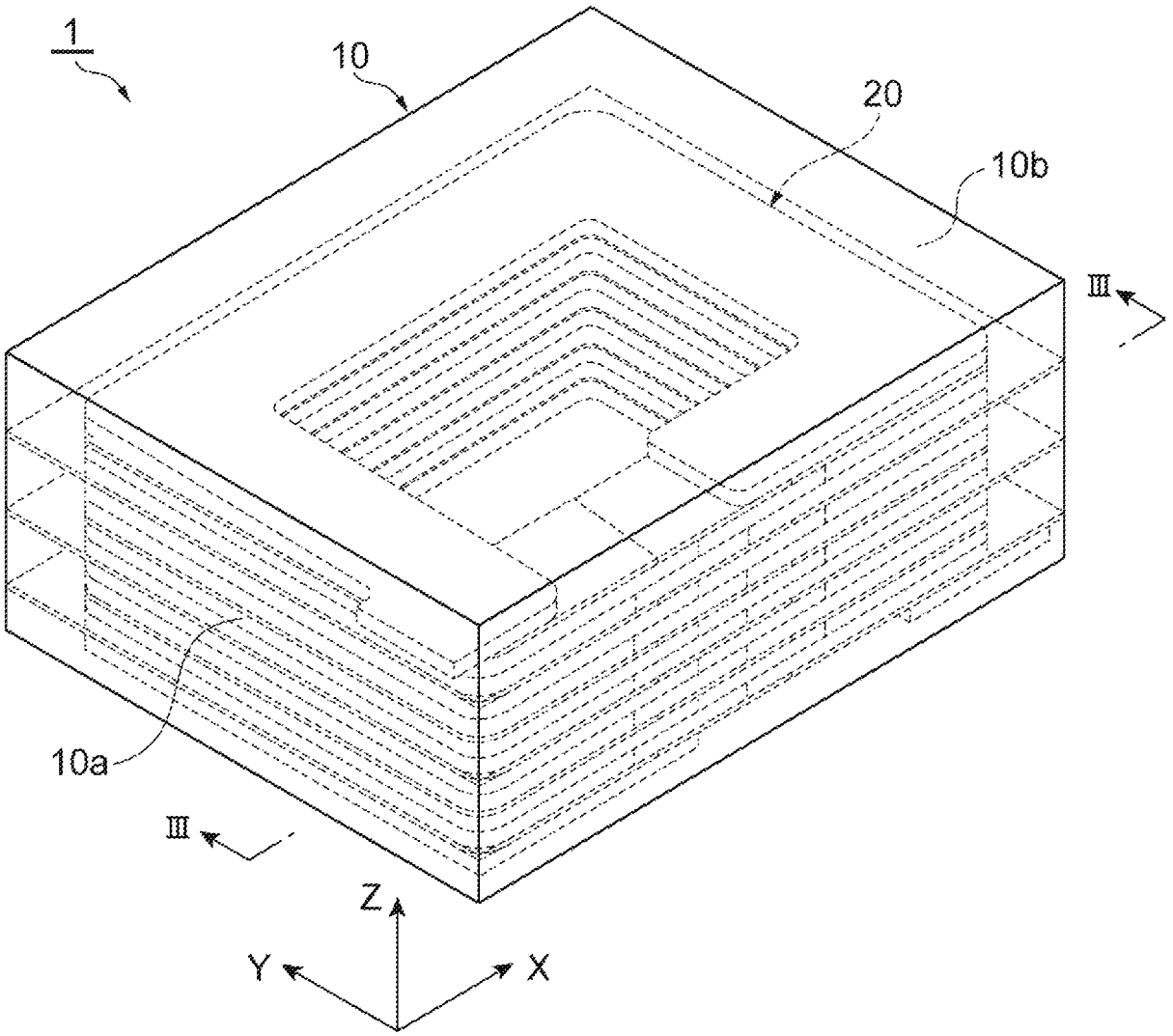
FIG. 2 is a perspective view schematically illustrating an inner structure of an insulating body of the multilayer coil component illustrated in FIG. 1.

As illustrated in FIG. 1, the multilayer coil component 1 is formed of an insulating body 10 having an outer shape of an approximate rectangular parallelepiped shape, and a coil 20 formed inside the insulating body 10. The multilayer coil component has a laminated structure including layers L1 to L20 as shown in FIGS. 1 and 2. Note that, external terminal electrodes 12A, 12B are provided on a pair of opposed end faces 10*a*, 10*b* of the insulating body 10, respectively. As an example, the multilayer coil component 1 is designed to be 2.0 mm in the long side, 1.6 mm in the short side, and 0.9 mm in the height.

For convenience of description, XYZ coordinates are set as illustrated in the drawings. That is, a laminated direction of the multilayer coil component 1 is set as Z direction, an opposing direction of the end faces 10*a*, 10*b* on which the respective external terminal electrodes are provided is set as X direction, and a direction perpendicular to Z direction and X direction is set as Y direction.

The insulating body 10 has insulation properties and is structured by an insulation-coated granular magnetic material. As the magnetic material, a ferrite (for example, Ni—Cu—Zn series ferrite, Ni—Cu—Zn—Mg series ferrite, Cu—Zn series ferrite), a metal magnetic material (Fe, Fe—Si, Fe—Si—Cr, Fe—Si—Al alloy, and the like), a composite material of a metal and a ferrite, or the like can be employed. Among layers L1 to L20 forming the multilayer coil component 1, the cover layers of the uppermost layer L1 and the lowermost layer L20 is wholly structured by the above-mentioned magnetic material. The other layers are also structured by the above-mentioned magnetic material except the portion where the coil 20 is formed.

Figure 3:
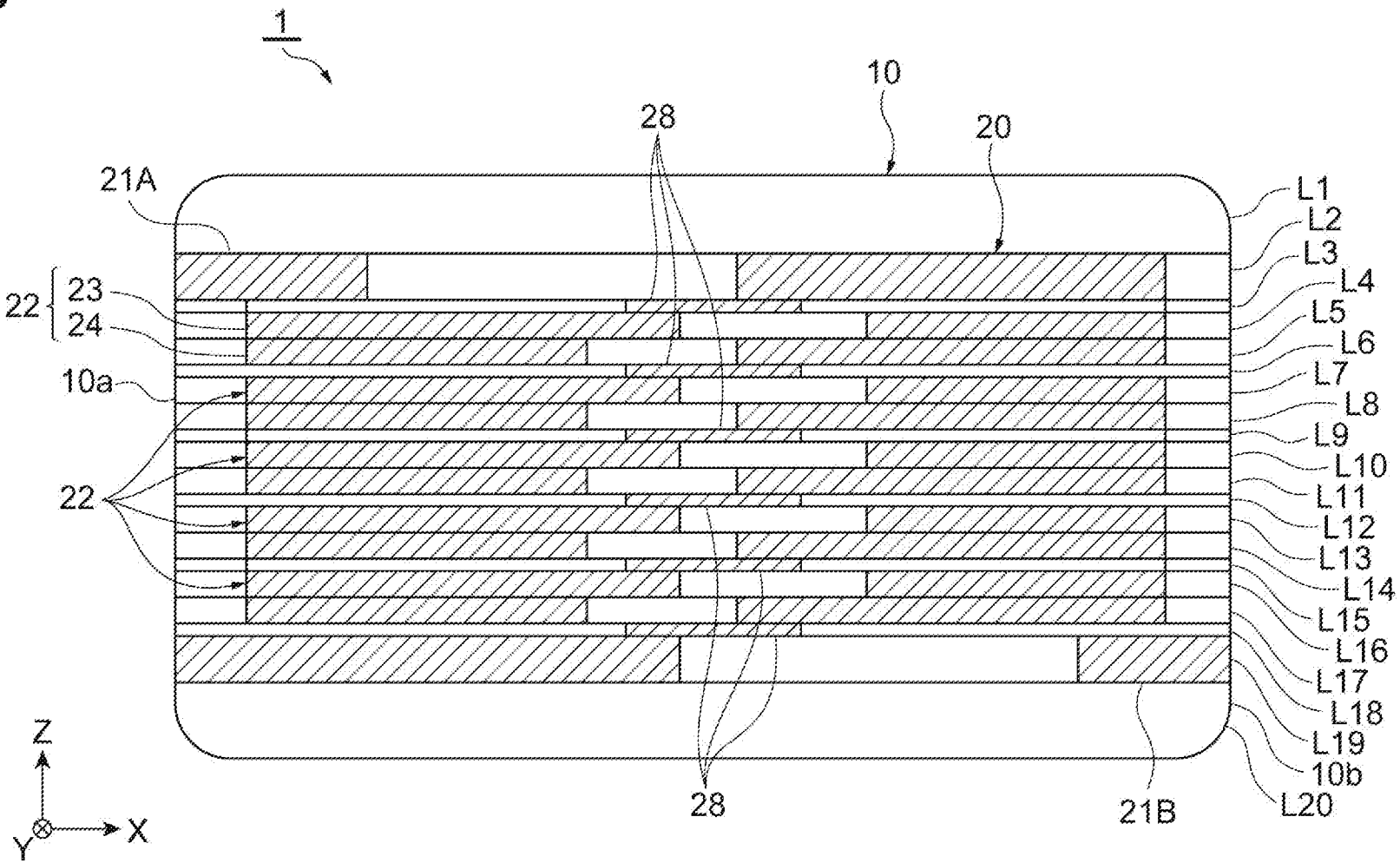
FIG. 3 is a cross sectional view taken along line of the insulating body illustrated in FIG. 2.

The coil 20 is formed of a plurality of laminated metal layers. The material of the metal layers is not specifically limited and includes Ag, Cu, Au, Al, Pd, Pd/Ag alloy, and the like. A Ti compound, a Zr compound, a Si compound, and the like may be added to the metal layers. Such metal layers can be formed by a printing method or a thin film growing method. As shown in FIG. 3, the coil 20 includes a lead-out electrode 21A extended to one end face 10*a* on which the external terminal electrode is provided, and a lead-out electrode 21B extended to the other end face 10*b* on which the external terminal electrode is provided.

Figure 4:
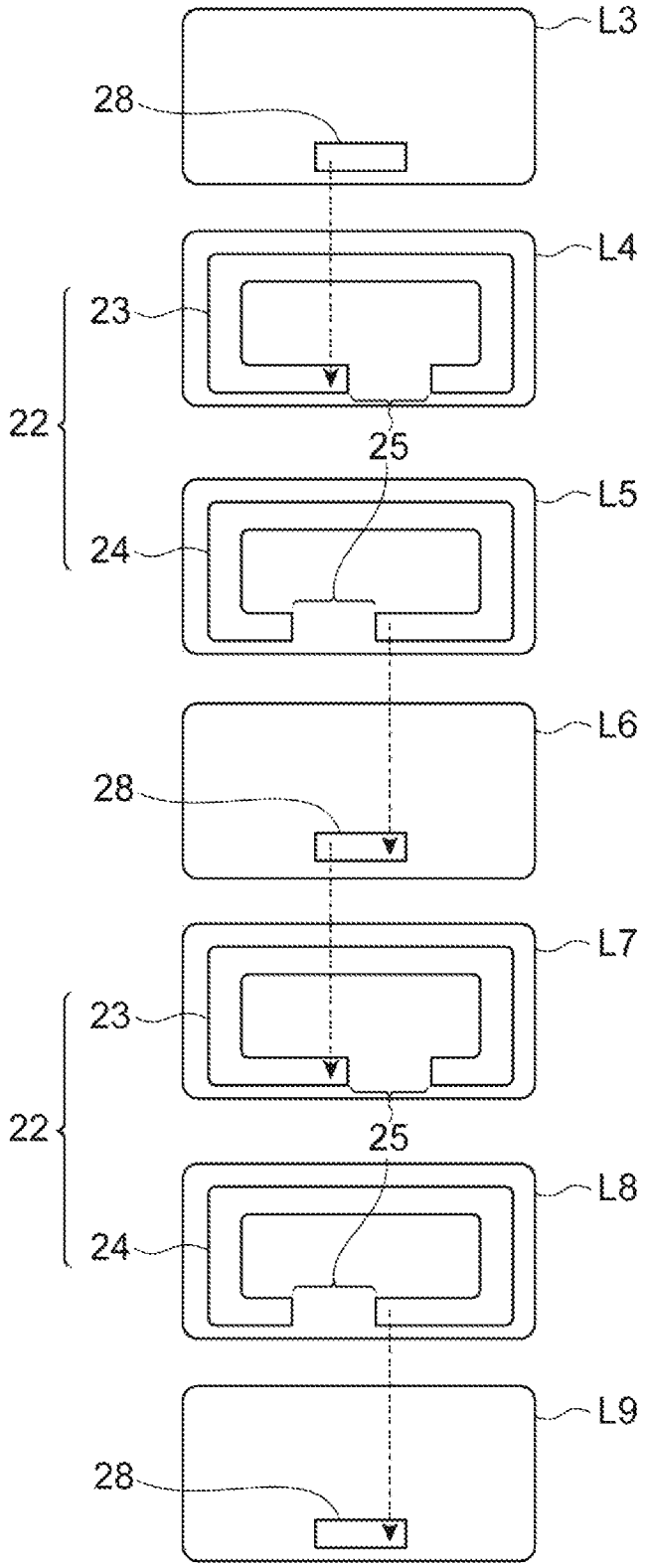
FIG. 4 is a diagram illustrating parts of a layer configuration of the multilayer coil component illustrated in FIG. 1.

As illustrated in FIGS. 3, 4, the coil 20 includes a plurality of coil parts 22 each forming one turn of the coil, and a plurality of connecting parts (second coil part) 28 connecting corresponding two coil parts 22. The coil parts 22 having the same shape and the connecting parts 28 having the same shape are alternately aligned in the laminated direction. Note that each coil part 22 of the embodiment is structured by two metal layers that are an upper coil layer (third coil part) 23 and a lower coil layer (first coil part) 24, and each connecting part 28 is structured by one metal layer. As an example, a thickness of the upper coil layer 23 is 40 μm, a thickness of the lower coil layer 24 is 40 μm, and a thickness of the connecting part 28 is 20 μm.

Herein, the coil part 22 has an approximate annular shape having a divided portion 25 as its portion when viewed from the laminated direction. The coil part 22 may have a C character shape as shown in FIG. 4. The coil part 22 has a pair of ends formed of a first end 22*a* and a second end 22*b* sandwiching the divided portion 25 and opposing to each other via the divided portion 25.

However, the position of the divided portion 25 in the upper coil layer 23 and the position of the divided portion 25 in the lower coil layer 24 are deviated in the opposing direction of the first end 22*a* and the second end 22*b* (that is, X direction). More specifically, in the first end 22*a*, the upper coil layer 23 is extended on the side of the divided portion 25 more than the lower coil layer 24. In contrast, in the second end 22*b*, the lower coil layer 24 is extended on the side of the divided portion 25 more than the upper coil layer 23.

The connecting part 28 is arranged at the position corresponding to the position of the divided portion 25 of the coil part 22, and has a rectangular shape extending along the opposing direction of the pair of ends 22*a*, 22*b* (that is, along the shape of the divided portion 25). The connecting part 28 connects the upper and lower coil parts 22 adjacent vertically to each other in the laminated direction. That is, the connecting part 28 is arranged in an annular coil forming area when viewed from the laminated direction, ensuring a sufficient inner diameter of the coil.

Figure 5:
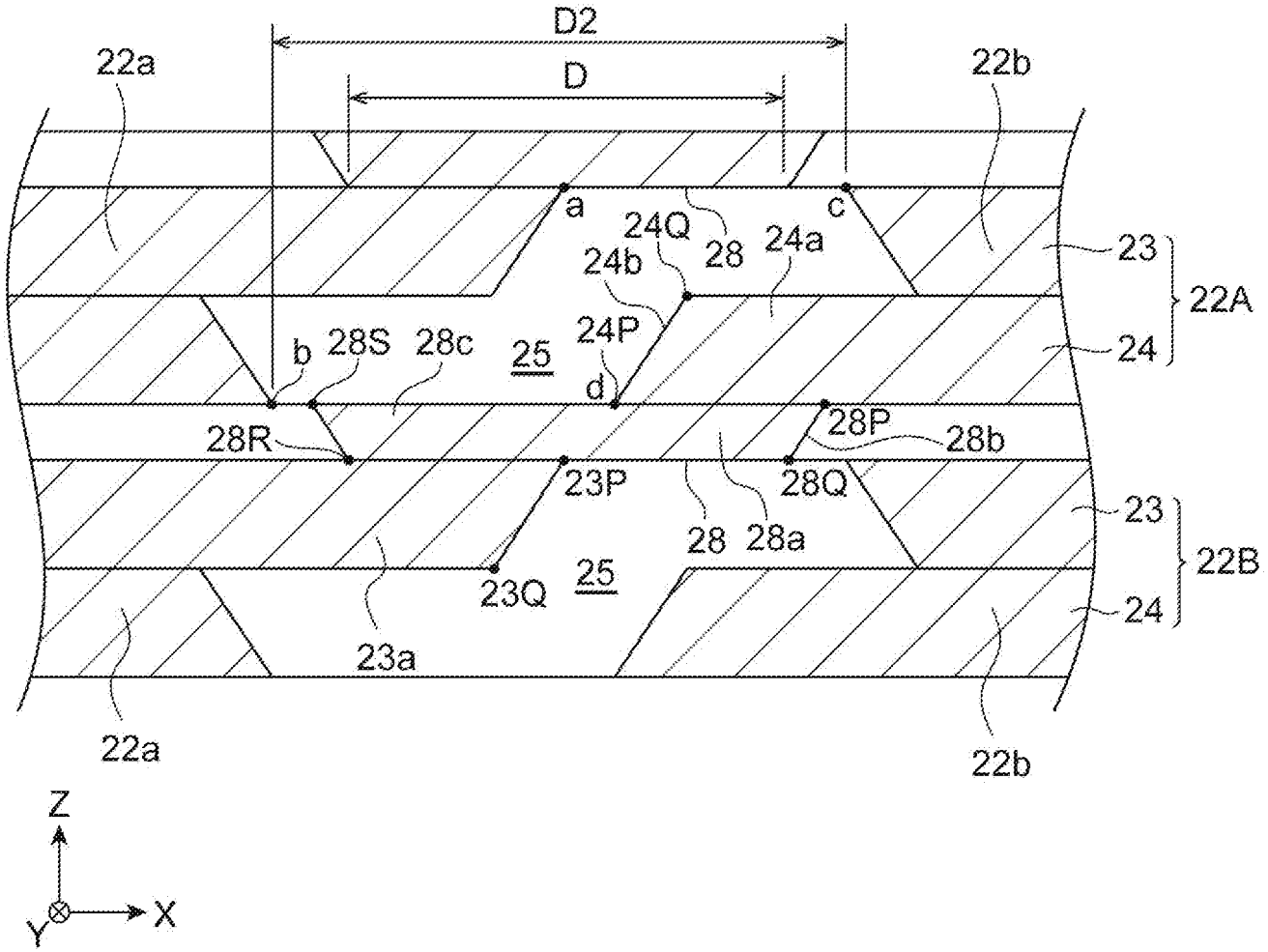
FIG. 5 is a main part enlarged view of the cross sectional view illustrated in FIG. 3.

Next, a positional relationship between the coil part and the connecting part will be described in more detail with reference to FIG. 5. FIG. 5 is a vertical section (X-Z cross section) parallel to the opposing direction (X direction) in which the pair of ends 22*a*, 22*b* of the coil part 22 are opposed, and illustrates the upper end position and the lower end position of the first end 22*a* in the laminated direction as an a point and a b point, respectively, and illustrates the upper end position and the lower end position of the second end 22*b* in the laminated direction as a c point and a d point, respectively. Note that, of the two coil parts 22 in FIG. 5, the coil part 22 on the upper side and the coil part 22 on the lower side are also referred to as a first coil part 22A and a second coil part 22B, respectively, as needed.

As illustrated in FIG. 5, the b point, the a point, the d point, and the c point are aligned without overlapping in this order from the side of the first end 22*a* in the opposing direction of the ends 22*a*, 22*b* of the coil part 22 (first coil part 22A).

The a point at the upper end position of the first end 22*a* is located on the connecting part 28 on the upper side, and the first end 22*a* is connected to the connecting part 28 on the upper side. The b point at the lower end position of the first end 22*a* is located at a retreated position with respect to the connecting part 28 on the lower side, and the first end 22*a* is not connected to the connecting part 28 on the lower side.

The c point at the upper end position of the second end 22*b* is located at a retreated position with respect to the connecting part 28 on the upper side, and the second end 22*b* is not connected with the connecting part 28 on the upper side. The d point at the lower end position of the second end 22*b* is located on the connecting part 28 on the lower side, and the second end 22*b* is connected to the connecting part 28 on the lower side.

Note that the length D of the connecting part 28 in the opposing direction is designed to be longer than the separation distance D1 between the a point at the upper end position of the first end 22*a* and the d point at the lower end position of the second end 22*b*, and to be shorter than the separation distance D2 between the b point at the lower end position of the first end 22*a* and the c point at the upper end position of the second end 22*b*.

As shown in FIG. 5, the shapes of the pair of ends 22*a*, 22*b* of the second coil part 22B on the lower side are same as the shapes of the pair of ends 22*a*, 22*b* of the first coil part 22A on the upper side. Furthermore, when viewed from the laminated direction, the pair of ends 22*a*, 22*b* of the second coil part 22B is located at the positions same as the positions of the pair of ends 22*a*, 22*b* of the first coil part 22A. Note that, not only the first coil part 22A and second coil part 22B, but also the other coil parts 22 have the pair of ends 22*a*, 22*b* having the same shapes and being located at the same positions when viewed from the laminated direction. Furthermore, each of the pairs of ends 22*a*, 22*b* are the same shapes, making each of the divided portions 25 sandwiched by the corresponding pair of ends 22*a*, 22*b* same in shape.

Furthermore, as shown in FIGS. 4 and 5, each of the plurality of connecting parts 28 forming the coil 20 has the same shape (that is, rectangular shape) and is located at the same position when viewed from the laminated direction.

As described above, in the multilayer coil component 1, the coil parts 22 each having the pair of ends 22*a*, 22*b* having the same shapes, and the connecting parts 28 each having the same shape are alternately aligned in the laminated direction, and any of the coil parts 22 and the connecting parts 28 has the same positional relationship. That is, each connecting part 28 connects the coil parts 22 adjacent vertically to each other in the laminated direction by connecting the second end 22*b* of the first coil part 22A on the upper side in the laminated direction, and the first end 22*a* of the second coil part 22B on the lower side in the laminated direction. Such a connection structures the coil 20 wound around along the laminated direction that allows current to flow in the coil parts 22 adjacent vertically to each other in a same circumferential direction.

As described above, in the multilayer coil component 1, even when the pair of ends 22*a*, 22*b* of each of the first coil part 22A and the second coil part 22B are located at the same positions when viewed from the laminated direction and have the same shapes, the connecting part 28 is connected only to the second end 22*b* of the first coil part 22A on the upper side in the laminated direction, and is connected only to the first end 22*a* of the second coil part 22B on the lower side in the laminated direction. This makes it possible to form the coil 20 wound around along the laminated direction without misaligning the positions of the respective connecting parts 28 even when the connecting part 28 is further provided on the upper side of the first coil part 22A or on the lower side of the second coil part 22B.

Therefore, in the multilayer coil component 1, the entire shape of each of the plurality of coil parts 22 can be designed to be the exact same shape, which makes it possible to reduce the number of types of coil part 22, saving labor and time for preparing many types of conductor patterns like the conventional type.

Furthermore, in the multilayer coil component 1, when viewed from the laminated direction, the connecting part 28 is arranged in the coil formation area to ensure a large inner diameter of the coil, making it possible to achieve high coil characteristics (for example, inductance or Q-value).

Furthermore, in the multilayer coil component 1, the coil parts 22 adjacent vertically to each other are not overlapped to each other in the connecting part 28, suppressing increase of the thickness of the connecting part 28. This also suppresses occurrence of large inner stress around the connecting part 28.

One method of manufacturing the multilayer coil component 1 described above using, for example, a printing method is repeating printing from the lowermost layer L20 to laminate layers one by one. In this case, the cross sections of the coil part 22, and the like probably have a gently curved outline different from the angular outline as illustrated in FIGS. 3 and 5.

Alternatively, it is also possible that a plurality of layers (for example, three layers of L3 to 5) is formed as one unit, and a plurality of the units is overlapped to manufacture the multilayer coil component 1. In this case, it is possible to efficiently manufacture the multilayer coil component 1 as compared with the method of laminating layers one by one by a printing method.

Furthermore, as illustrated in FIG. 5, an end 24*a* of the lower coil layer 24 and an end 28*a* of the connecting part 28 are directly overlapped, and the end (one end) 24*a* of the lower coil layer 24 includes a contact edge 24P positioned on the side of the connecting part 28 and being in contact with the connecting part 28, and a non-contact edge 24Q positioned on the side opposite to the connecting part 28 and not being in contact with the connecting part 28. The contact edge 24P and the non-contact edge 24Q are not overlapped when viewed from a laminated direction (Z direction). Therefore, as illustrated in FIG. 6, an end face 24*b* of the end 24*a* of the lower coil layer 24 is inclined with respect to the laminated direction.

Herein, in the above-mentioned multilayer coil component 1, a crack can be generated due to stress from outside of the component. Specifically, when a stress is applied on the end face 24*b* of the end 24*a* of the lower coil layer 24, the stress is dispersed along the end face 24*b*, which can cause a crack (crack along a dashed-dotted line Si of FIG. 6) extending in parallel to end face 24*b* from a point near the contact edge 24P as an origination on the end 28*a* of the connecting part 28. In this context, when the end face 24*b* is inclined with respect to the laminated direction as illustrated in FIG. 6, the propagation distance of the crack becomes longer as compared with the case where the end face 24*b* is in parallel to the laminated direction as illustrated in FIG. 7 (that is, the length of dashed-dotted line Si>the length of dashed-dotted line S1'). Consequently, as illustrated in FIG. 6, the effect of suppressing the above-mentioned advance of crack becomes larger in the case where the end face 24*b* is inclined with respect to the laminated direction, so that the advance of crack is effectively suppressed. Suppressed advance of a crack in this manner makes the multilayer coil component 1 provide a high component strength as a whole.

Figure 6:
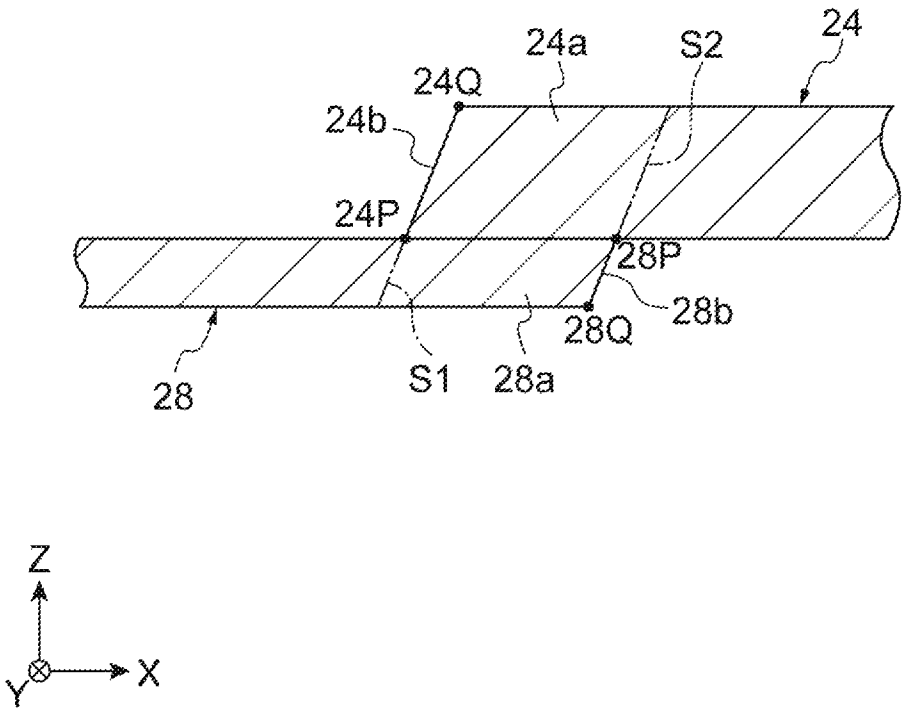
FIG. 6 is a diagram illustrating a cross sectional shape of a coil part according to the embodiment.
Figure 7:
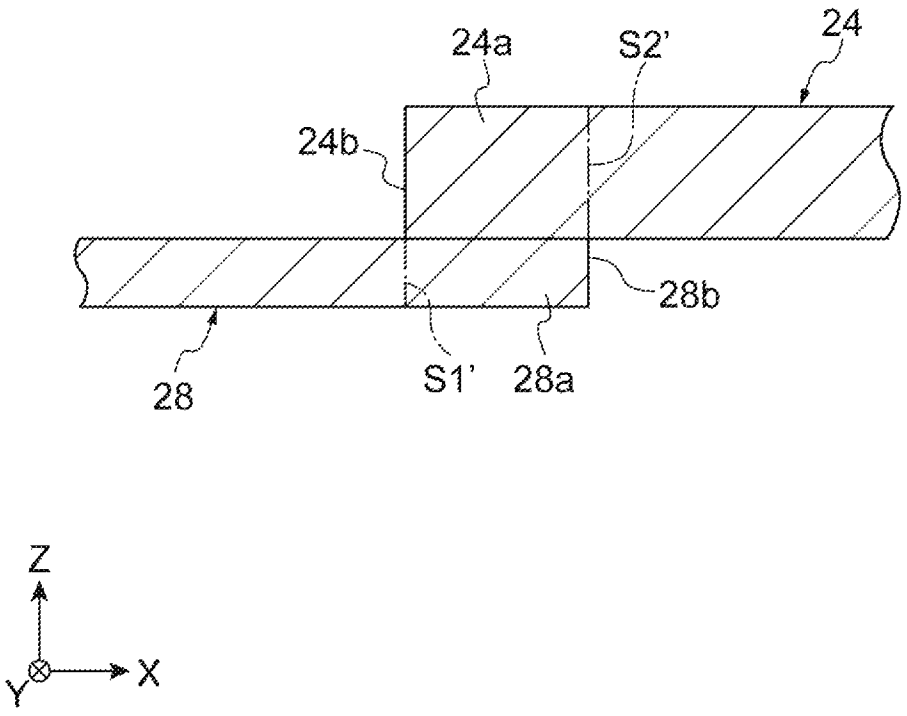
FIG. 7 is a diagram illustrating a cross sectional shape of a conventional coil part.

As illustrated in FIG. 6, in the multilayer coil component 1, besides the end 24*a* of the lower coil layer 24, the end 28*a* of the connecting part 28 also includes a contact edge 28P and a non-contact edge 28Q that are not overlapped when viewed from the laminated direction. Consequently, when a stress is applied on an end face 28*b* of the end 28*a* of the connecting part 28, also in a crack extending in parallel to the end face 28*b* from the contact edge 28P as an origination (crack along dashed-dotted line S2 in FIG. 6) that can be generated on the end 24*a* of the lower coil layer 24, a propagation distance of the crack becomes longer as compared with the case where the end face 28*b* is parallel to the laminated direction as illustrated in FIG. 7 (that is, the length of the dashed-dotted line S2>the length of the dashed-dotted line S2'), so that the advance of the crack is effectively suppressed, further improving component strength.

Furthermore, in the multilayer coil component 1, in the end 24*a* of the lower coil layer 24 and the end 28*a* of the connecting part 28, the contact edges 24P, 28P are respectively positioned more to the distal end side in the end extending direction than the non-contact edges 24Q, 28Q. Accordingly, a large contact area can be ensured between the lower coil layer 24 and the connecting part 28. In this case, direct current resistance of the coil 20 is reduced. Note that, the above-mentioned effect can be achieved as long as the contact edge is positioned more to the distal end side in the end extending direction than the non-contact edge in at least one of the end 24*a* of the lower coil layer 24 and the end 28*a* of the connecting part 28.

Furthermore, in the multilayer coil component 1, as illustrated in FIG. 5, an end 23*a* of the upper coil layer 23 is directly overlapped with another end 28*c* of the connecting part 28 on the side opposite to the lower coil layer 24 with respect to the connecting part 28. The other end 28*c* of the connecting part 28 also has a contact edge 28R and a non-contact edge 28S that are not overlapped when viewed from the laminated direction. Consequently, when a stress is applied on an end face of the end 28*c* of the connecting part 28, also in a crack that extends in parallel to the end face from the contact edge 28R as an origination and that can be generated on the end 23*a* of the upper coil layer 23, a propagation distance of the crack becomes longer, so that advance of the crack is effectively suppressed, improving further component strength.

Likewise, the end 23*a* of the upper coil layer 23 is directly overlapped with the other end 28*c* of the connecting part 28 on the side opposite to the lower coil layer 24 with respect to the connecting part 28. The end 23*a* of the upper coil layer 23 also has a contact edge 23P and a non-contact edge 23Q that are not overlapped when viewed from the laminated direction. Consequently, when a stress is applied to an end face of the end 23*a* of the upper coil layer 23, also in a crack that extends in parallel to the end face from the contact edge 23P as an origination and that can be generated on the end 28*c* of connecting part 28, a propagation distance of the crack becomes longer, so that the advance of the crack is effectively suppressed, improving further component strength.

The above-mentioned connecting part 28 is improved in its element properties when its thickness is thin, so that its thickness is designed to be thinner than the thickness of the upper coil layer 23 and the thickness of the lower coil layer 24. However, when the thickness of the connecting part 28 is thin, the possibility that the crack penetrates becomes high. Therefore, by inclining the end faces of the end 23*a* of the upper coil layer 23 and the end 24*a* of the lower coil layer 24 with respect to the laminated direction, the propagation distance of crack is elongated, effectively suppressing that a crack penetrates the connecting part 28.

Note that the multilayer coil component is not limited to the embodiment described above, and can be modified in various manners.

Figure 8:
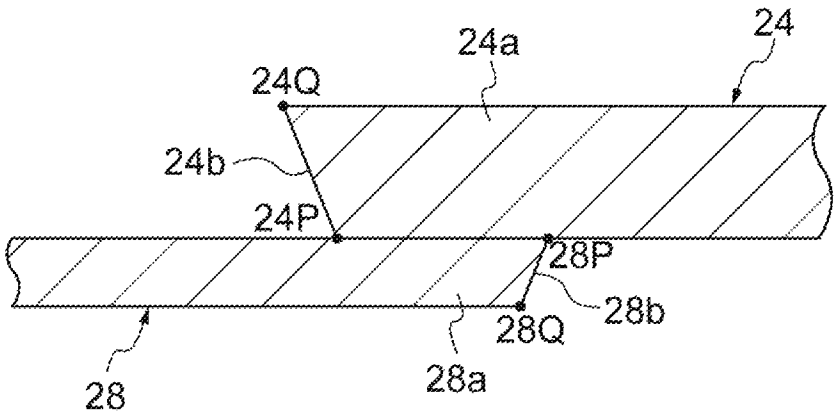
FIG. 8 is a diagram illustrating a cross sectional shape of a coil part different from that in FIG. 5.
Figure 9:
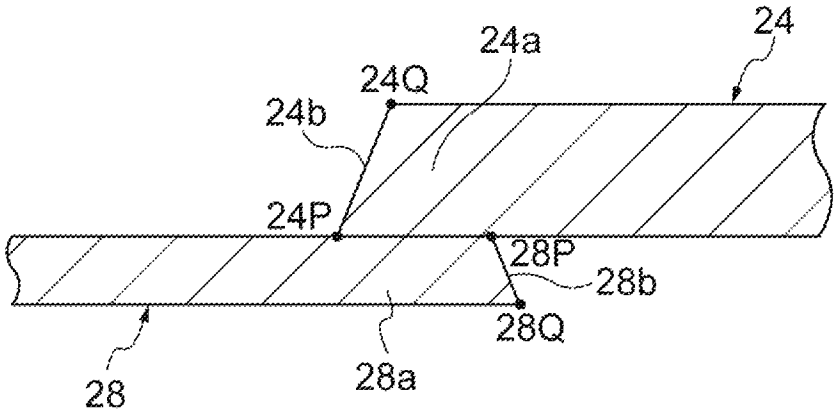
FIG. 9 is a diagram illustrating a cross sectional shape of a coil part different from that in FIG. 5.
Figure 10:
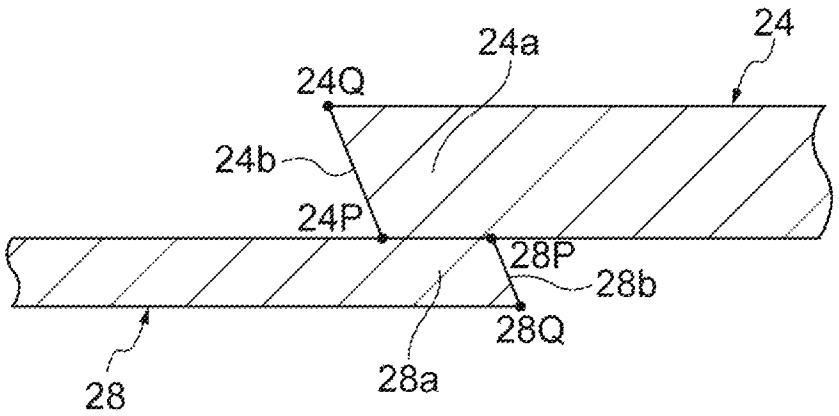
FIG. 10 is a diagram illustrating a cross sectional shape of a coil part different from that in FIG. 5.

For example, the shape of the end 24*a* of the lower coil layer 24 and the shape of the end 28*a* of the connecting part 28 can be appropriately changed, and the examples illustrated in, for example, FIGS. 8 to 10 may be employed.

In the example illustrated in FIG. 8, in the end 24*a* of the lower coil layer 24, the non-contact edge 24Q is positioned more to the distal end side in the end extending direction than the contact edge 24P. Furthermore, in the end 28*a* of the connecting part 28, the contact edge 28P is positioned more to the distal end side in the end extending direction than the non-contact edge 28Q.

In the example illustrated in FIG. 9, in the end 24*a* of the lower coil layer 24, the contact edge 24P is positioned more to the distal end side in the end extending direction than the non-contact edge 24Q. Furthermore, in the end 28*a* of the connecting part 28, the non-contact edge 28Q is positioned more to the distal end side in the end extending direction than the contact edge 28P.

In the example illustrated in FIG. 10, in the end 24*a* of the lower coil layer 24, the non-contact edge 24Q is positioned more to the distal end side in the end extending direction than the contact edge 24P. Furthermore, in the end 28*a* of the connecting part 28, the non-contact edge 28Q is positioned more to the distal end side in the end extending direction than the contact edge 28P.

The planar shape of the coil part may be a circular shape, an ellipse shape, or the like instead of the rectangular ring shape. Furthermore, each coil part does not necessarily need to be the exact same shape as the entire shape as long as at least the shapes of the pair of ends are same shapes. Furthermore, it is not necessary that the coil part forms one turn, and a coil part forming one half turn or one quarter turn may be employed. Furthermore, the coil part does not necessarily need to be two layers structure, and single layer structure or multilayer structure of not less than three layers may be employed. The number of the laminated layers of the multilayer coil component can be increased or reduced in any manner as needed.

Furthermore, it is not necessary that the connecting part has a shape extending in one direction when viewed from the laminated direction, and may have a bend shape or a curved shape. For example, when the shape of the coil part in plan view is a polygonal annular shape, using a connecting part having a bent shape or a curved shape makes it possible to connect upper and lower coil parts at the position corresponding to a corner of the coil part.

What is claimed is:

1. A multilayer coil component having a laminated structure and including a coil inside an insulating body, the multilayer coil component comprising:

a first coil part configured to be a part of the coil and extending in a layer forming the laminated structure, the first coil part having one end extending in one direction;

a second coil part configured to be a part of the coil and extending in a layer forming the laminated structure, the second coil part having one end extending in a direction opposite to the one end of the first coil part and directly overlapping the one end of the first coil part in a laminated direction, wherein the one end of at least one of the first coil part and the second coil part has a contact edge positioned on a side of the other coil part and being in contact with the other coil part, and a non-contact edge positioned on a side opposite to the other coil part and not being in contact with the other coil part, and the contact edge and the non-contact edge are not overlapped when viewed from the laminated direction.

2. The multilayer coil component according to claim 1, wherein both of the one ends of the first coil part and the second coil part have the contact edge and the non-contact edge, and the contact edge and the non-contact edge are not overlapped when viewed from the laminated direction in both of the one ends of the first coil part and the second coil part.

3. The multilayer coil component according to claim 1, wherein the contact edge is positioned more to a distal end side in an end extending direction than the non-contact edge in the one end of at least one of the first coil part and the second coil part.

4. The multilayer coil component according to claim 3, wherein the contact edge is positioned more to the distal end side in the end extending direction than the non-contact edge in both of the one ends of the first coil part and the second coil part.

5. The multilayer coil component according to claim 1, wherein the second coil part has another end extending in one direction, and the multilayer coil component further includes a third coil part configured to be a part of the coil and extending in a layer forming the laminated structure, the third coil part extending in a direction opposite to the other end of the second coil part and having one end directly overlapping the other end of the second coil part on a side opposite to the first coil part with respect to the second coil part.

6. The multilayer coil component according to claim 5, wherein a thickness of the second coil part is thinner than any of a thickness of the first coil part and a thickness of the third coil part.

* * * * *